US006038712A

United States Patent [19]

Chalberg et al.

[11] Patent Number: 6,038,712

[45] Date of Patent: Mar. 21, 2000

[54] SAFETY SUCTION ASSEMBLY FOR USE IN WHIRLPOOL BATHS AND THE LIKE

[75] Inventors: Philip E. Chalberg; Patrick B. Healy, both of Costa Mesa, Calif.

[73] Assignee: Hydrabaths, Inc., Santa Ana, Calif.

[21] Appl. No.: 08/946,930

[22] Filed: Oct. 8, 1997

[51] Int. Cl.[7] ..... A47K 3/00; E04H 4/12

[52] U.S. Cl. ..... 4/507; 4/541.2; 4/504; 4/507; 417/151

[58] Field of Search ..... 4/504, 507, 509, 4/541.1, 541.4, 541.5, 689; 417/77, 87, 179

[56] References Cited

U.S. PATENT DOCUMENTS 5,167,041 12/1992 Burkitt, III .
5,499,406 3/1996 Chalberg et al. .

*Primary Examiner*—Charles R. Eloshway
*Assistant Examiner*—Lynette C. Goodwin
*Attorney, Agent, or Firm*—Leonard Tachner

[57] ABSTRACT

A suction assembly employs an air induction tube to induct air into the recirculating water pump to cause the pump to cease pumping operation when the front face of the assembly is blocked. The induction tube is connected to a bleed path formed between the induction tube and a surrounding coaxial face tube extended into the assembly from the front face. When the face is blocked by hair or the like, water in the induction tube bleeds into the main chamber of the assembly and empties the induction tube. Air is then pulled into the pump, causing the pump to lose prime thereby reducing pump pressure to zero and allowing the hair or other blocking material to be removed. In a preferred embodiment, the induction tube is connected to the air inlet of at least one venturi-type hydromassage jet assembly. The suction assembly employs a spring-loaded induction stem which bears compressively against the interior face of the suction cover, thereby permitting use of conventional suction covers.

5 Claims, 8 Drawing Sheets

SAFETY SUCTION ASSEMBLY FOR USE IN WHIRLPOOL BATHS AND THE LIKE

BACKGROUND OF THE INVENTION

1. Field of the Invention

The present invention relates generally to the field of spas and whirlpool baths and more specifically to a suction fitting component thereof, which is designed to prevent serious accidents resulting from the trapping of hair and the like which can result in drowning.

2. Prior Art

Whirlpool baths and spas commonly use a plurality of venturi-type jets which mix air and water and propel the combination into a tub filled with water. A pump is normally used to suction water from the interior of the tub and force it through the jets which employ the well-known venturi effect to entrap air as well, to create a bubble-type forceful spray of water for massage and the like. In order to facilitate the withdrawal of the water from the tub by the pump, whirlpool baths are provided with what is called a suction fitting which is positioned within a hole in the wall of the tub at a height below the water surface and which is connected to the pump inlet so that the force of the pumping action sucks the water out of the tub through the hole and the fitting. Typically, the face of the fitting, which is readily visible in the interior of the tub, is configured to provide a protective covering that has a plurality of small apertures. Such a configuration allows water to be sucked through the small apertures of the suction fitting, but attempts to prevent hair and body parts, such as elbows and the meaty part of the body from being sucked into the suction fitting which may hold the individual against the wall adjacent the suction fitting and cause an accident or other discomfort.

Unfortunately, it has been found that even with the small orifices in the cover of the suction fitting, accidents can still happen and in fact, do happen, some resulting in drowning. Such accidents may result from the trapping of hair of an individual whose head is below the surface of the water. The hair may be sucked through the small apertures and be trapped in the suction fitting, thereby preventing the person whose hair is trapped, from being able to stand and remove his head from adjacent the suction fitting. This severe problem of a potential drowning accident has resulted in certain attempts to solve that problem by divising systems which sense the blockage of the suction fitting cover and turn off the pump when that occurs, so that the negative suction pressure falls to zero, the hair can be released and the person can stand and avoid accidental drowning. An example of such prior art is disclosed in U.S. Pat. No. 5,167,041 to Burkitt. The Burkitt patent discloses a suction fitting having a suction line connected to the pump for circulating the water in the tub and also having a pressure sensor line connecting to a water level sensor, which is, in turn connected to the pump control which is connected to the pump for turning it on and off in response to the level sensor. The water level sensor is a float assembly having a float which moves up and down within a chamber, the float's motion being determined by the water level in the tub when the suction assembly is unblocked. On the other hand, when the face of the suction assembly is blocked, a plurality of slots in the protective cover permits the suction effect of the pump to pull water through those slots. The water exits from the sensor line, thereby reducing the water level in the float chamber, activating a switch, which in turn turns off the pump, thereby reducing the suction level to zero and permitting the blockage to be removed. While the Burkitt disclosure describes a device which can overcome the prior art safety hazard described above, it suffers from a number of disadvantages which can still have a significant effect on the actual safety of the device, as well as on other commercially important features of the suction assembly. By way of example, the Burkitt device relies on a plurality of elongated slots in the protective cover of the suction fitting. These slots radiate from the central opening of the suction assembly cover to a plurality of suction openings in the face or cover of the suction fitting, separated from the central opening thereof. Unfortunately, this safety feature assumes that whatever is blocking the face of the suction fitting, will not also block the passage of water within these slots. However, the most common material that may block the face of a suction fitting of the type herein described is human hair and human hair is flexible enough, soft enough and fine enough to also block the slots of the Burkitt device and thus impede the safety function thereof. Furthermore, these slots in the face or cover of the suction fitting of the Burkitt disclosure may detract from the aesthetic appearance of the cover and therefore become unattractive from a commercial standpoint. Furthermore, a safety cover with slots is more difficult to mold in plastic or form in sheet metal and more difficult to plate, such as plating with various coatings, including metal coatings, to give the face a particular metal appearance such as a gold or silver appearance, which is common in the whirlpool bath industry. Furthermore, the Burkitt device is dependent for its proper operation on the use of the float chamber and a pair of switches mounted on the outside of the float chamber, which must operate properly and reliably for the pump to be turned off in response to the position of the float within the chamber. However, it is well-known that switches, particularly magnetic switches, can be unreliable and therefore either cause the safety feature of the Burkitt device to fail or to turn off the pump when there is no reasonable basis for doing so (i.e., even when the face of the suction fitting is not blocked).

The applicant's U.S. Pat. No. 5,499,406, issued Mar. 19, 1996, satisfies the need for a safety device for suction fittings for use in whirlpool baths which overcomes the disadvantages noted above. More specifically, there is disclosed for a device which can turn the pump off whenever the face of the suction fitting is blocked, without requiring the use of slots in the tub interior face of the suction fitting, without requiring that the face have special slots which detract from its aesthetic appearance and without requiring that the face have slots which can increase the difficulty of plastic molding or metal forming and plating which can otherwise increase the cost of such devices. Most importantly however, U.S. Pat. No. 5,499,406 satisfies the need for a suction fitting pump turn off mechanism which does not depend on moving parts or potentially unreliable electrical, mechanical or magnetic switches which can either fail to operate when required to or operate when it is unnecessary. However, there are two potential inconveniences associated with the embodiments disclosed in U.S. Pat. No. 5,499,406 to which the improvements disclosed herein are directed to overcoming. One such inconvenience is the remote possibility of water leakage through the induction tube and out through the air filter behind the tub wall 18. The other such inconvenience is the need to provide a specially configured suction cover to secure the induction stem within the body while permitting water to bleed from the induction tube upon blockage of the cover.

SUMMARY OF THE INVENTION

The suction assembly disclosed herein meets the aforementioned needs by providing a blockage sensing mechanism for the face of a suction fitting of a whirlpool bath, wherein the face exterior is not slotted or otherwise changed from its nominal configuration and wherein shutdown of pumping action is assured, without the use of electric, magnetic or mechanical components which would otherwise detract from reliability and/or create a risk of false pump turn off which would detract from the overall commercial viability of the suction assembly.

The suction assembly disclosed herein overcomes these disadvantages by providing at least two significant improvements relative to the Burkitt disclosure of the prior art. More specifically, in the present invention, there is no need for a float chamber or switches. Instead, the disclosed suction assembly utilizes an air induction tube which is connected through the suction assembly to the pump inlet and which is normally filled with water to the level of the water in the tub. However, when the face of the suction fitting is blocked, the water in the induction tube is effectively sucked out, thereby exposing the pump inlet to air. Air is then induced into the water pump, and immediately stops the pump action, reducing the pump negative pressure to zero and thereby permitting the blockage to be removed from the face of the fitting. An additional improvement of the disclosed suction assembly is the use of a suction fitting assembly design which permits the water in the aforementioned induction tube to be sucked out, without requiring any slots in the face of the fitting. This is accomplished by utilizing a safety suction tube and a fluidic diverter body in the interior of the suction fitting assembly which channels the water in the induction tube, into the pump suction portion of the fitting. This channeling of water is done without requiring water in the induction tube to flow through the apertures in the face of the fitting. This unique design obviates the prior art requirement for the slots in the prior art face.

Thus, the suction assembly disclosed herein meets the requirements for providing a safety device for shutting down the pump when the face of the suction fitting is blocked, but without requiring the prior art slots in the face, which otherwise diminish the level of safety and increase the cost of plastic molding or metal forming and plating the face of the suction fitting and otherwise diminish the aesthetic appearance thereof. Furthermore, there is no requirement for the use of a float chamber, nor for any form of switches required in the prior art.

The invention herein comprises certain improvements to the disclosed suction assembly, which improvements are specially designed to obviate the potential inconveniences disclosed above. More specifically, in the presently improved version of the suction assembly previously disclosed in U.S. Pat. No. 5,499,406, the induction tube is connected into the air inlet of at least one venturi-type jet assembly at the air control to assure that any water backing up through the induction tube will not leak behind the tub wall. Another improvement disclosed herein comprises a spring-loaded two-part induction stem which bears compressively against the inside surface of the suction cover. This new induction stem permits use of conventional suction covers while still assuring a flow path to bleed the induction tube of water upon suction cover blockage and induce loss of pump pressure in the manner described in U.S. Pat. No. 5,499,406.

OBJECTS OF THE INVENTION

It is therefore a principal object of the present invention to provide an improved safety suction assembly for use in whirlpool baths for shutting down the pumping action and thus relieving the suction effect at the interior face of the fitting, whenever the face is blocked, such as by human hair and the like.

It is an additional object of the present invention to provide an improved safety suction fitting assembly for use in whirlpool baths which obviates the prior art requirement for using a special face having slots therein.

It is still an additional object of the present invention to provide an improved safety suction assembly for use in whirlpool baths which effects a total shutdown of the pumping action, whenever the face of the fitting is blocked, the shutdown being accomplished without the use of any switching components which might otherwise reduce the reliability of such a safety device.

It is still an additional object of the present invention to provide an improved safety suction fitting assembly for use in whirlpool baths which effectively shuts the pumping action down whenever the fitting face is blocked, such shutdown being effected by inducing air into the pump and without relying on any moving parts, such as a float assembly or the like.

It is still an additional object of the present invention to provide an improved suction fitting assembly which is more resistant to leakage and which may be used with conventional suction covers.

BRIEF DESCRIPTION OF THE DRAWINGS

The aforementioned objects and advantages of the present invention, as well as additional objects and advantages thereof will be more fully understood hereinafter as a result of a detailed description of preferred embodiments of the invention when taken in conjunction with the following drawings in which.

DETAILED DESCRIPTION OF PREFERRED EMBODIMENTS

Figure 1:
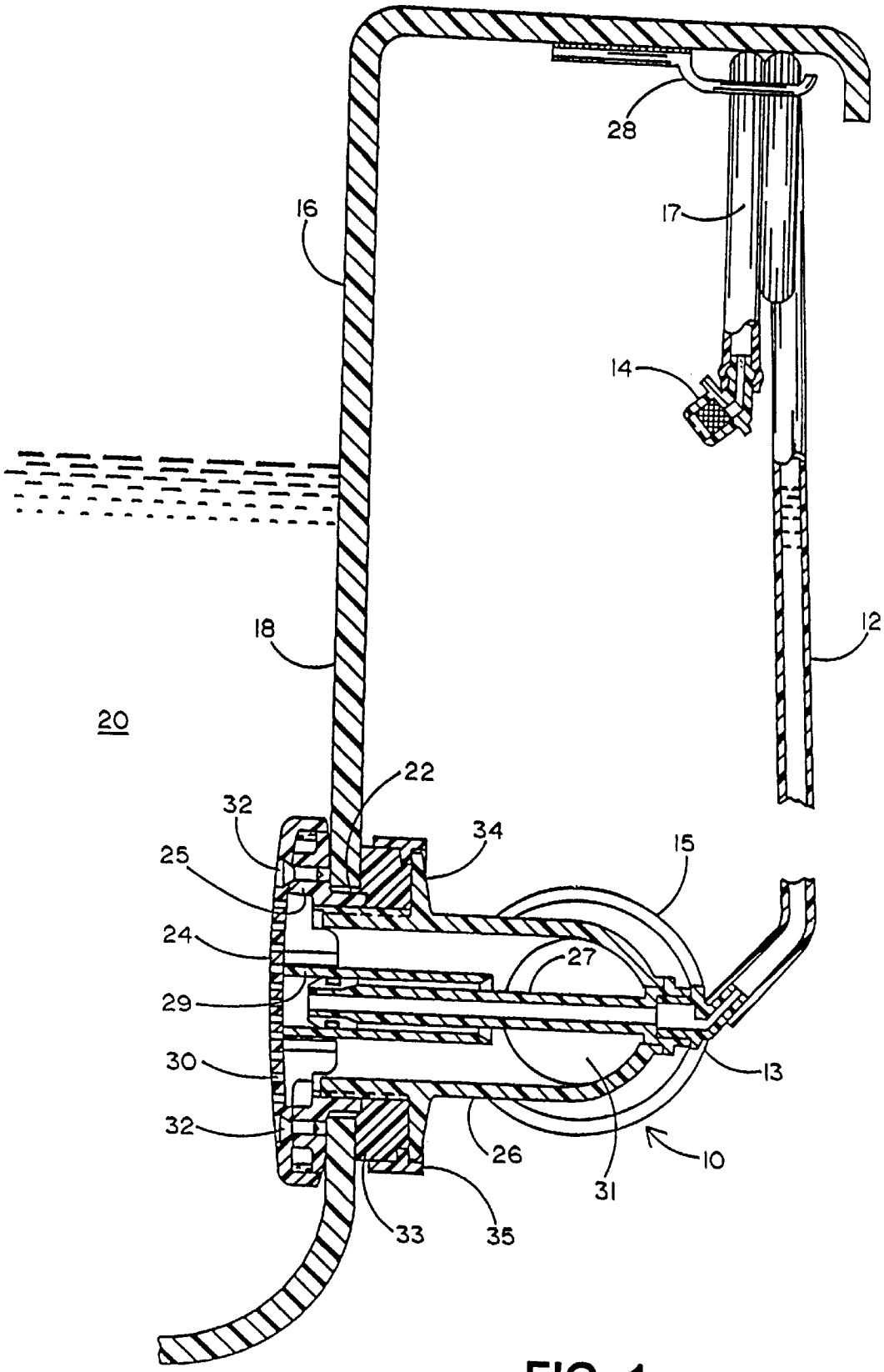
FIG. 1 PRIOR ART
FIG. 1 is a cross-sectional view of a portion of a bath tub illustrating the configuration of a suction assembly installed in an aperture of a tub wall.

Referring initially to FIG. 1, it will be seen that a prior art suction assembly 10 of the present invention is affixed to a tub 16 and particularly to the wall 18 thereof, through an aperture 22. The interior of the tub is partially filled with water 20, so that the suction fitting 10 is positioned in the tub wall 18 below the surface of the water. The assembly 10 comprises a body 26, which is connected to a pump inlet connecting pipe 15 and to an induction tube 12, by means of a fitting 13, at the end of a body 26, opposite the tub wall. Induction tube 12 extends upwardly towards the underside surface of the top of tub 16 where it is shaped into a loop 17, terminating at an optional air filter 14 and open to ambient air pressure. A tube holder 28 may be used to secure the loop portion of the induction tube to the interior surface of the tub. It will be understood that the induction tube 12 normally holds a column of water at the same height as the height of water 20 in tub 16 when the pump is not operating. Accordingly, the induction tube extends to the height of the tub 16 and includes the loop 17 in order to prevent water leakage outside of the tube, irrespective of the height of the water 20 within the tub. It will be further understood that due to water system dynamics, a water column is maintained in the induction tube 12 when the suction fitting 10 and pump are operating in a normal manner without blockage of the cover 24.

As seen further in FIG. 1, the suction assembly 10 is installed in the aperture 22 of the tub wall 18 by threading the body 26 to a threaded insert 25 to which in turn, a face or cover 24 is secured by a pair of fasteners such as screws 32. The resistance against leakage is accomplished by utilizing a seal 33 which is positioned immediately behind the aperture 22 in the tub wall 18 and which is compressed against the aperture perimeter by means of flange 34 and ring 35.

As seen further in FIG. 1 and more clearly in FIG. 2, the face or cover 24 provides a plurality of face apertures 30, which as will be seen hereinafter, provide passageways for water within the tub 16, to be sucked through the cover 24 and into the main chamber 31 of the body 26. It will also be seen in FIG. 1, that the cover 24 provides an integral interior extending face tube 29. Tube 29 is in coaxial overlapping relation with an induction stem 27 which extends axially and centrally within the body 26 toward the fitting 13 at the rear of the body.

Figure 2:
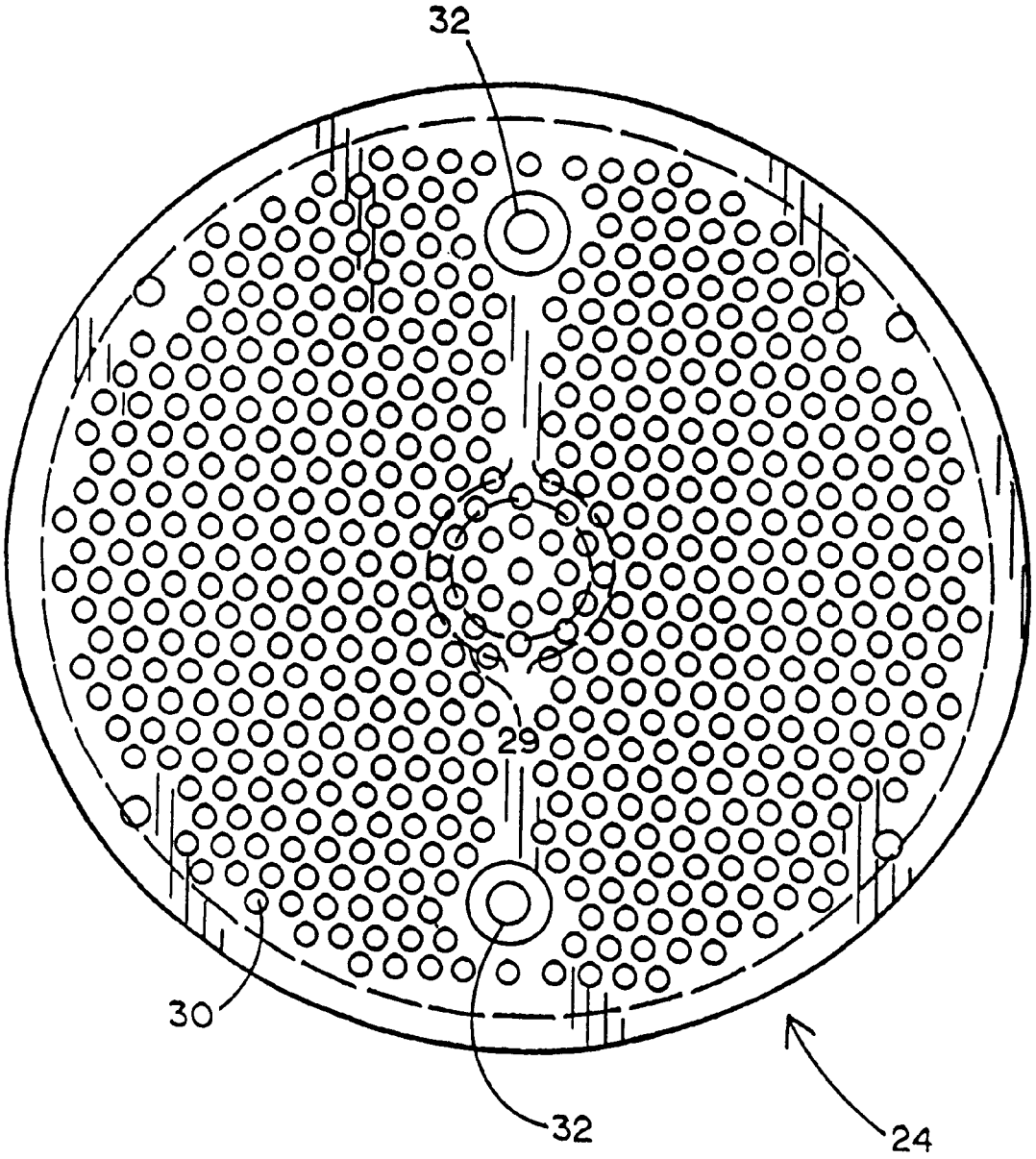
FIG. 2 PRIOR ART
FIG. 2 is an elevational view of an aperture interface that may be used in the suction assembly.

The face or cover 24 of the prior art suction assembly 10 is shown in FIG. 2 where it will be seen that the face 24 comprises a large plurality of face apertures 30. Also shown therein are the two screws 32 which secure the face to the underlying threaded insert 25 shown in FIG. 1. Also seen in FIG. 2 is the partially hidden face tube 29, extending rearwardly from the opposed surface of the face 24.

Figure 3:
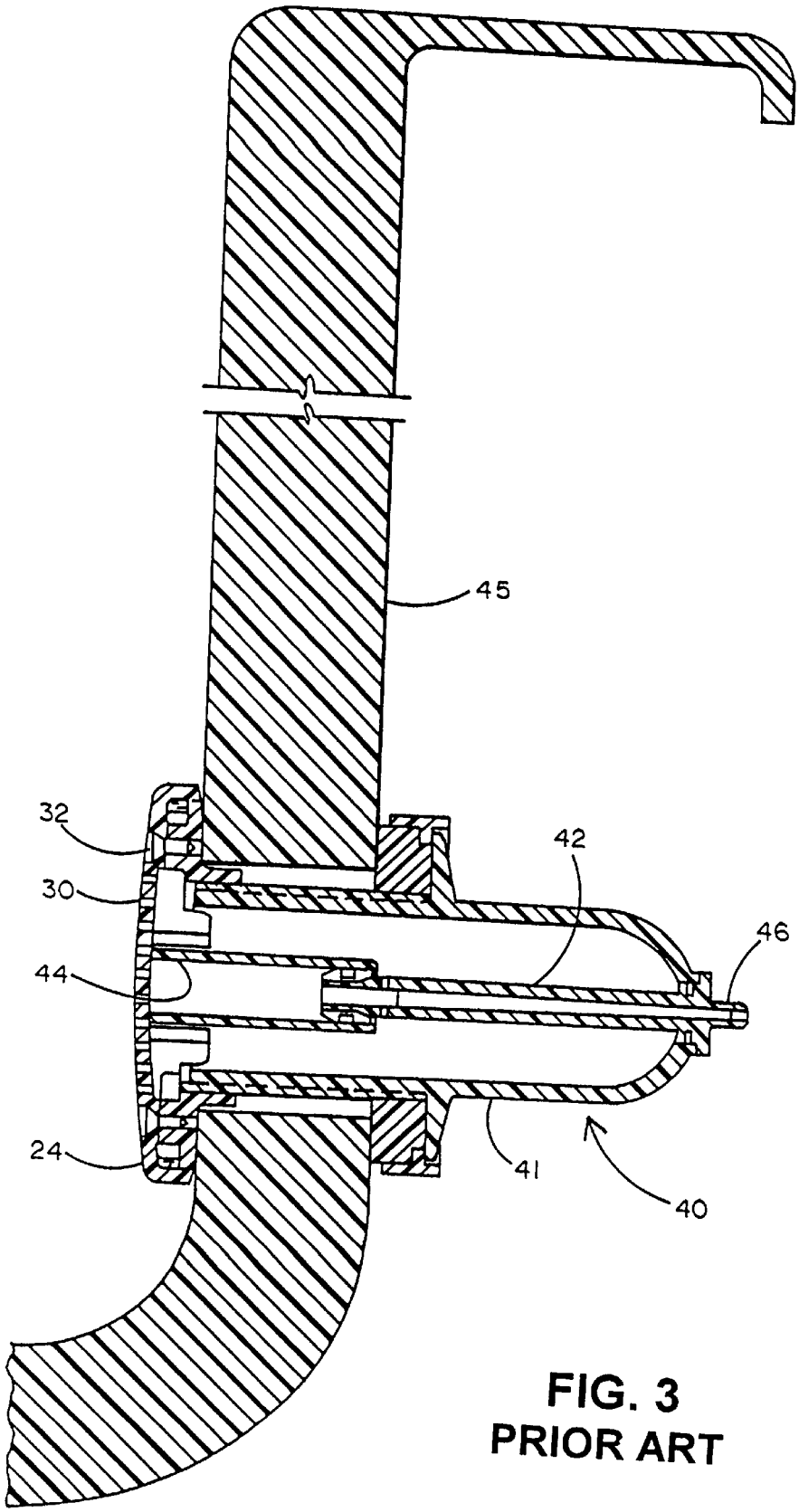
FIG. 3 PRIOR ART
FIG. 3 is a cross-sectional view of a suction assembly shown installed in a thick-walled tub.

A second embodiment 40 of the prior art suction assembly is shown in FIG. 3. This second embodiment is substantially the same as the embodiment of FIG. 1, but is configured for installation into a thick tub wall 45, by using an elongated body 41 which uses a longer threaded section between flange 34 and threaded insert 25 to accommodate the additional thickness of the wall. Although the induction stem 42 is substantially the same as induction stem 27 of the first embodiment and although the face tube 44 is substantially the same as the face tube 29 of the first embodiment, because of the additional length in the body 41 as compared to the body 26 of the first embodiment, the degree of coaxial overlap between the face tube and the induction stem is markedly reduced. In addition, the channel within the induction stem 42 is tapered slightly toward a connector 46 which is adapted to interface with an induction tube in the manner disclosed in FIG. 1.

Figure 4:
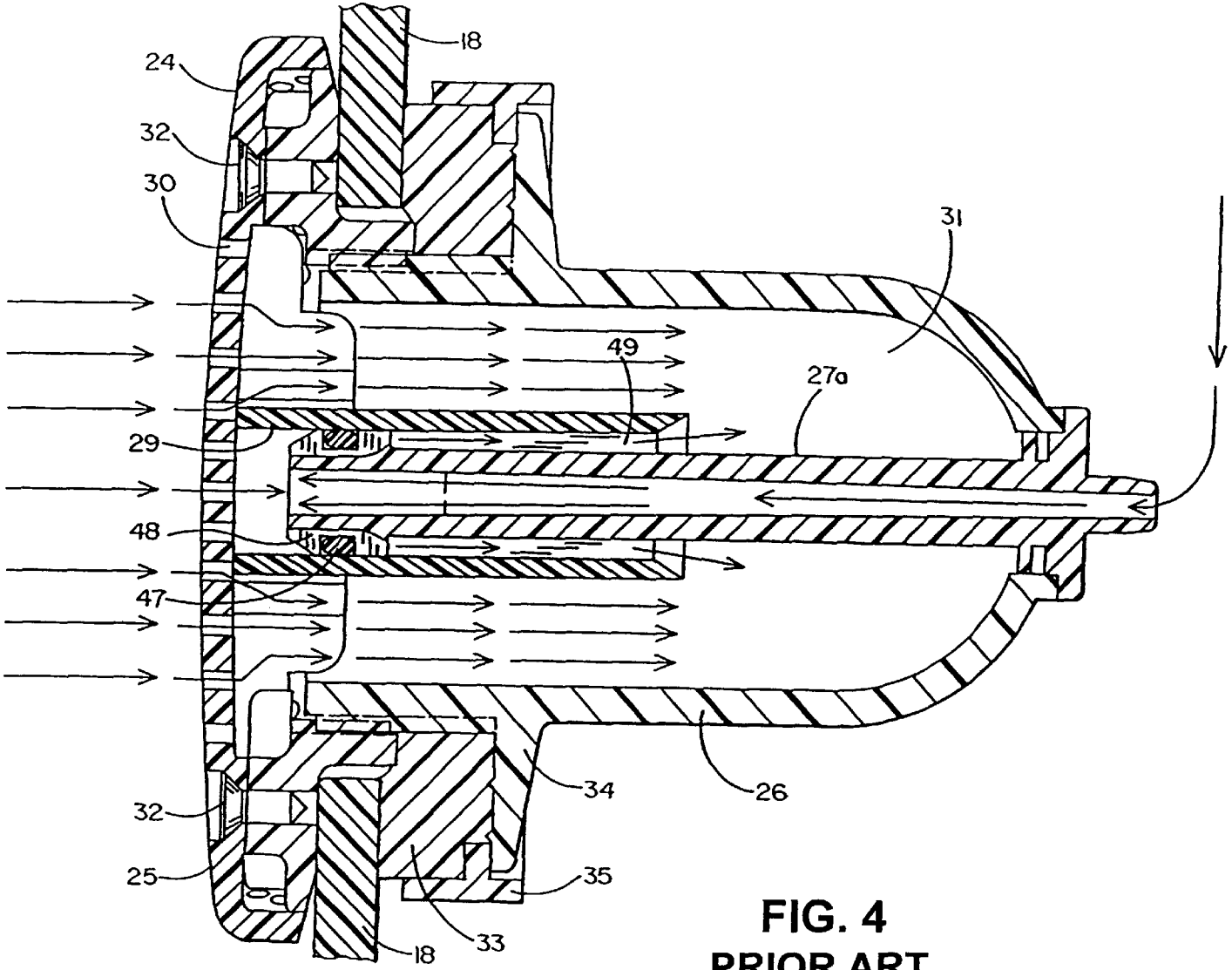
FIG. 4 PRIOR ART
FIG. 4 is an enlarged cross-sectional view of a suction assembly illustrating the flow characteristics thereof during normal operation of the suction fitting with the suction cover being unobstructed.
Figure 5:
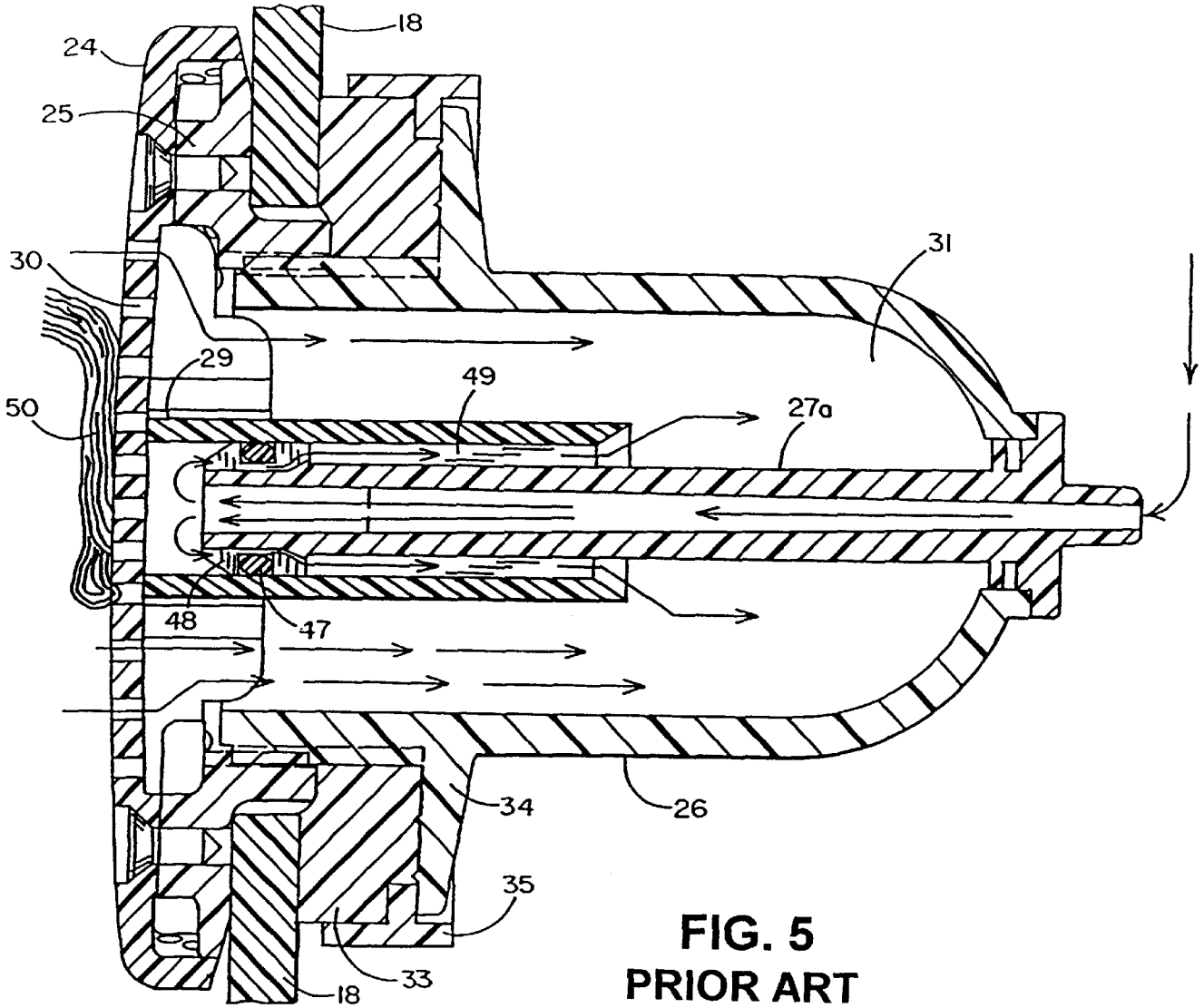
FIG. 5 PRIOR ART
FIG. 5 is a view similar to that of FIG. 4, but illustrating the flow characteristics with the suction cover obstructed.

The flow characteristics of the prior art suction assembly may be best understood by referring to FIGS. 4 and 5, which illustrate those characteristics for two distinct conditions. The first condition, which is depicted in FIG. 4, corresponds to normal operating conditions when the face or cover 24 is unblocked. FIG. 5 corresponds to the condition of flow within the suction assembly when at least the central portion of the face or cover 24 of the suction assembly is blocked by a material such as human hair. In both FIGS. 4 and 5, the pump inlet pipe 15 is omitted for purposes of minimizing the complexity of the drawings. However, it will be understood that the body 26 of the assembly shown in each FIGS. 4 and 5 is connected to an inlet pipe 15, such as that shown in FIG. 1.

Referring now first therefore to FIG. 4, it will be seen that normal operation, without blockage, provides water flow from the interior of the tub through the cover 24 and into the main chamber 31 of the body 26. Water flowing through those face apertures 30 which are radially outward of the face tube 29, flows directly into the main chamber 31 while water flowing through the apertures 30 radially inward of the face tube 29, flows into the region between the face tube 29 and the induction stem 27, establishing a positive pressure head at the open mouth of the induction stem 27. Water in this region then flows through at least one forward bleed path channel 48 and a rear channel 49 into the main chamber 31 of the body 26. It will be seen in FIGS. 4 and 5 that forward channel 48 and rear channel 49 are sequential channels formed between the face tube and the induction stem 27. It will also be seen that the forward channel 48 is separated from the interior surface of the face tube 29 by an O-ring 47. The purpose of O-ring 47 is to control the size of the forward channel 48 to a relatively small orifice area with a very low flow coefficient, limiting the bleed flow rate through the channel 48. In fact, the forward channel orifice is significantly smaller (i.e., one-tenth) than the size of the larger orifice areas of the face apertures 30 which have a relatively high flow factor, producing a flow rate that is larger than the bleed rate through the channel 48. As a result, a significant pressure head is formed at the opening of the induction stem 27, immediately behind the face or cover 24, within the radial perimeter of the face tube 29. This pressure head balances the pressure formed by the column of fluid that is present within the interior of the induction stem 27 and the connected induction tube which extends to the top of the tub as shown in FIG. 1.

Consequently, during normal operation and without obstruction of the cover 24, a column of water is always contained within the induction stem and the induction tube, so that only water reaches the pump inlet pipe and the pump operates normally. However, as shown in FIG. 5, when the face cover is obstructed, such as by blocking material 50, which may for example be human hair, water flow through the apertures 30, particularly within the radial perimeter of the face tube 29 is substantially or fully blocked. This blockage reduces the pressure head to zero or close to zero in the region between the opening of the induction stem 27 and the interior surface of the face cover 24, thereby permitting the column of water within the induction stem 27 and the attached induction tube to be drawn out and through the forward channel 48 and the rear channel 49, into the main chamber 31. This reduction in pressure head permits the induction stem 27A and attached induction tube to be drained of water. This can occur even when the remaining face apertures 30 radially exterior of the face tube 29, remain unblocked or substantially unblocked, allowing water to flow through those apertures, into the main chamber 31 and through the pump. However, as soon as the induction stem 27 and the attached induction tube are emptied of water, air then flows through the induction tube and the induction stem and that air is sucked through the forward channel 48 and the rear channel 49, into the main chamber 31 and the pump inlet. The introduction of air into the pump inlet causes the pump to cease proper operation. The pump pressure subsequently falls until there is little or no suction all along the interior surface of the face 24. At this point, there is no longer a force holding the material 50 against the suction assembly and the hair or other material that had been blocking the face cover 24 can then be readily withdrawn, unblocking the face. Once the material is withdrawn, the pressure head can then be gradually rebuilt to a sufficient degree to form a new column of water within the induction stem 27 and the attached induction tube, blocking air into the pump and allowing the system to resume normal operation as depicted in FIG. 4.

Thus, the prior art, suction assembly configuration is adapted to cause the attached pump to cease normal operation when the face cover of the assembly is blocked. Furthermore, the prior art suction assembly accomplishes this pump control without requiring the use of a slot or a plurality of slots in the face cover 24 which would otherwise detract from the appearance thereof and increase the difficulty of manufacturing. More importantly. The prior art suction assembly is designed to cause the pump to cease normal operation and release the blockage at the face cover 24, without the use of moving parts and thus without the potential reliability risks associated with utilizing moving parts or electrical or magnetic switches.

Figure 6:
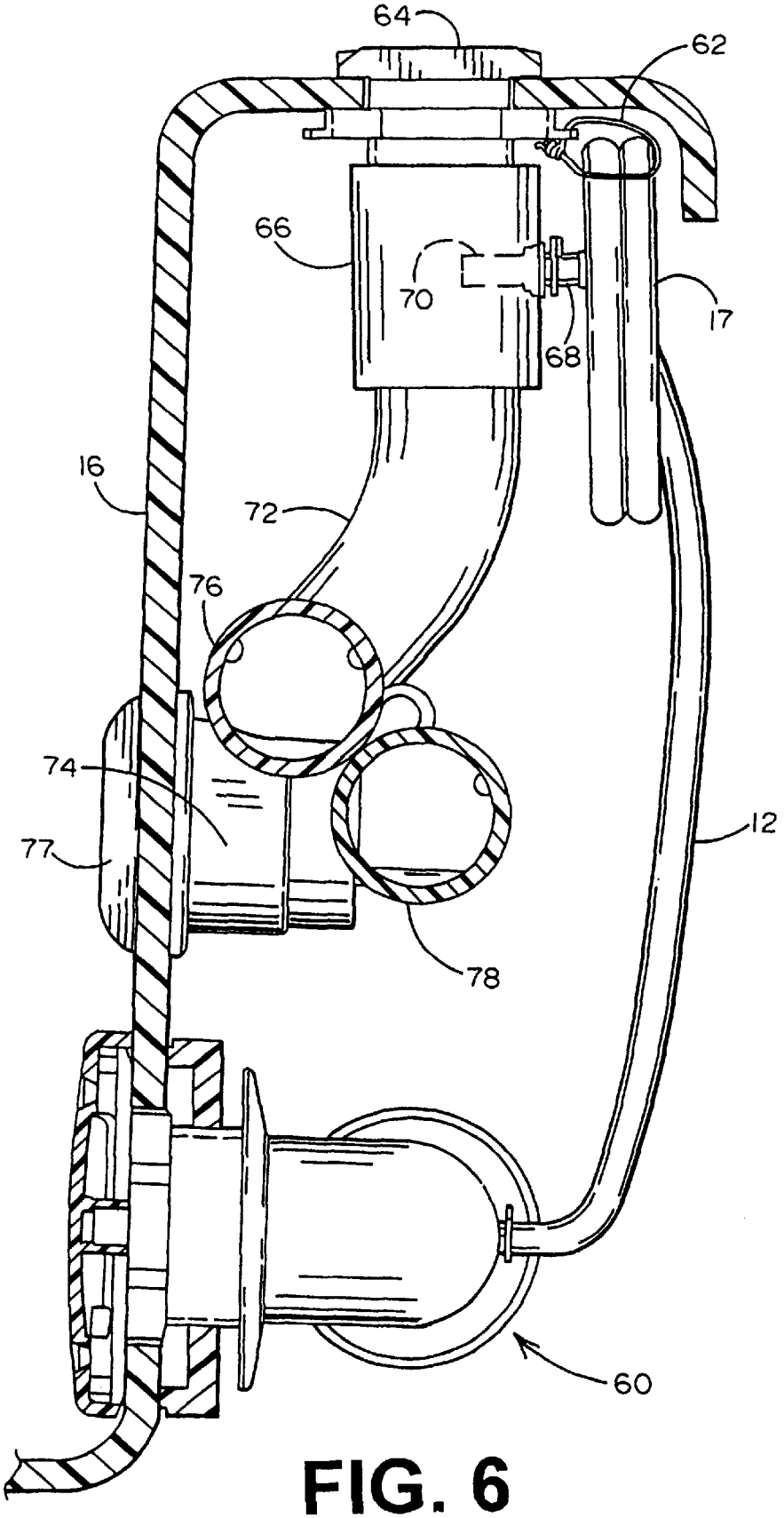
FIG. 6 is a cross-sectional view similar to that of FIG. 1 but illustrating an improved version thereof wherein the possibility of inadvertent water leakage is reduced.

The present invention will now be discussed in conjunction with FIGS. 6 to 12. In FIG. 6 it can be seen that a suction assembly 60 is connected by means of an induction tube 12 to the air line 76 of a venturi body 74 of a jet 77. Connection to the air line 76 is accomplished by securing the end 68 of the tube 12 to an air control fitting 66 by means of a tube connector 70. The fitting 66 is connected to an air control 64 at the top of tub wall 16. The induction tube 12 is preferably secured to the air control by means of a looped portion 17 and tiewrap 62 for mechanical stability. Venturi body 74 of jet 77 is of the type that is well known in the hydromassage system art and which mixes air from air inlet 76 and water from water inlet 78 which exit from jet 77 as a high speed air-water mixture for massaging body portions in front of the jet.

By connecting the induction tube 12 into the air line of at least one jet, the present invention is rendered more resistant to inadvertent water leakage. Even if water were to back up in induction tube 12, it would enter the air line instead of merely flowing out of the tube and behind the tub wall.

Figure 7:
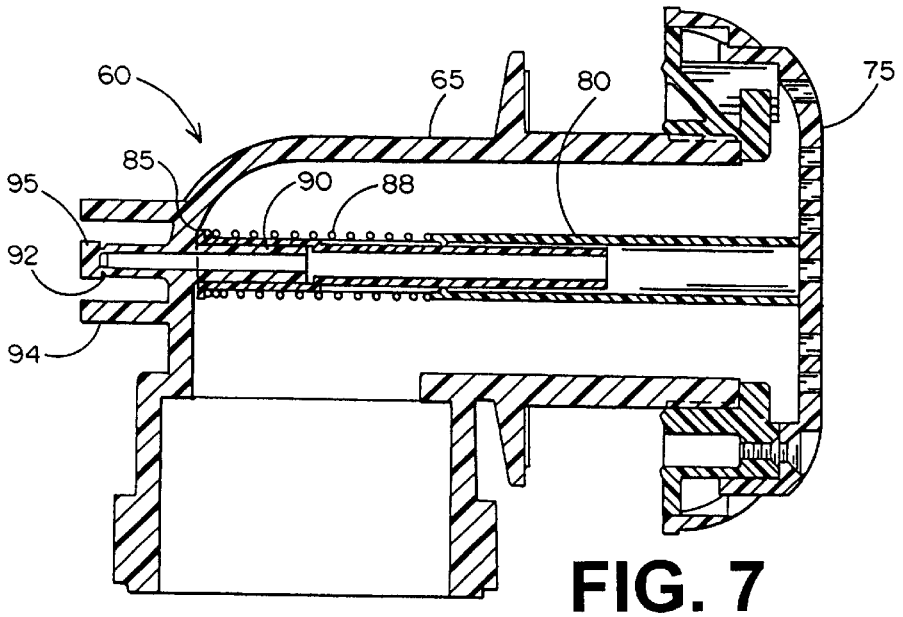
FIG. 7 is a cross-sectional view of an improved suction assembly body having a revised induction stem.
Figure 8:
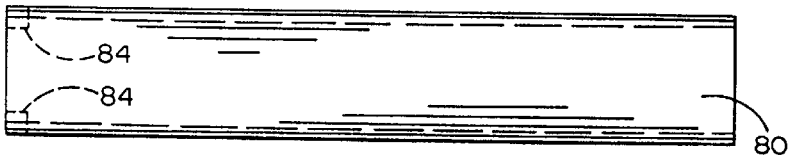
FIGS. 8 through 12 illustrate various elements of the improved induction stem.
Figure 9:
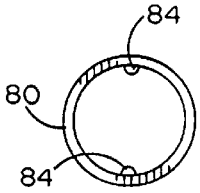
Figure 10:
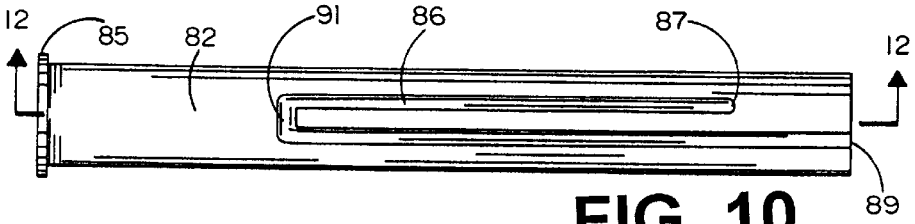
Figure 11:
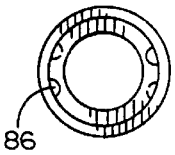
Figure 12:
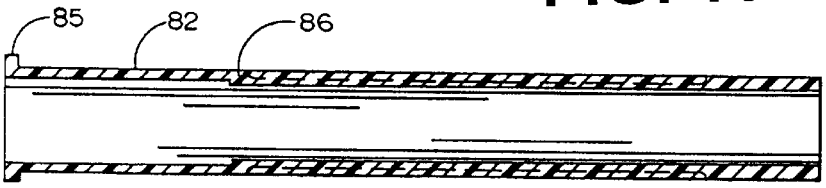
Figure 13:
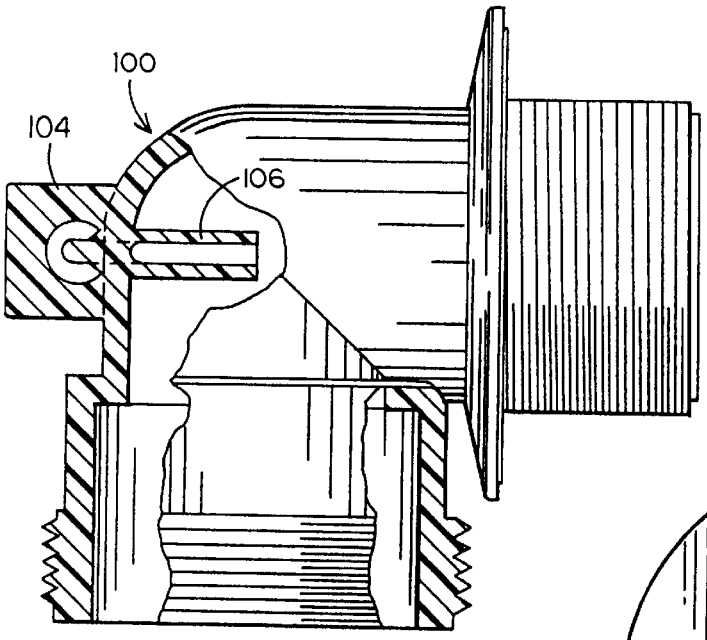
FIGS. 13 through 17 provide various views of an alternative embodiment of a suction assembly body in accordance with the invention.
Figure 14:
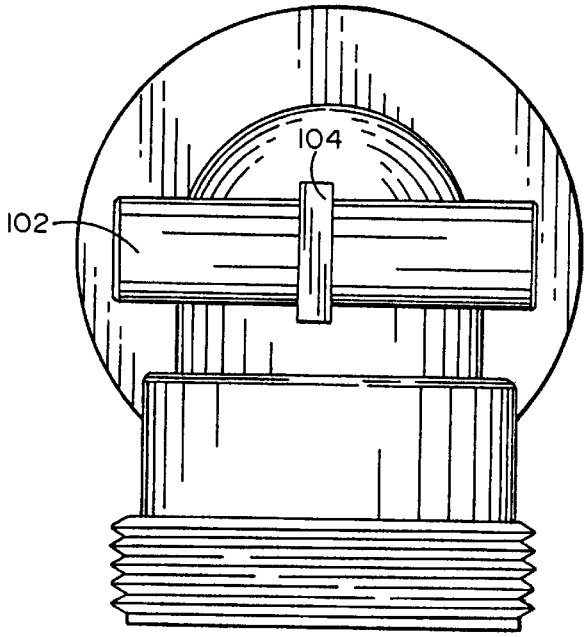
Figure 15:
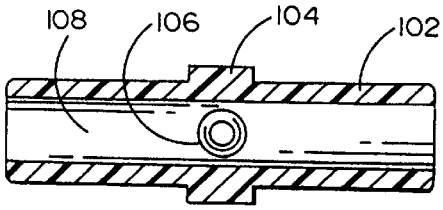
Figure 16:
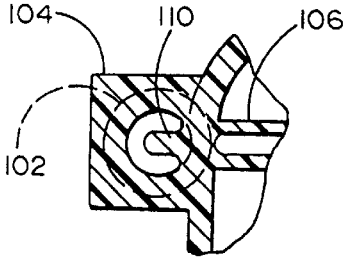
Figure 17:
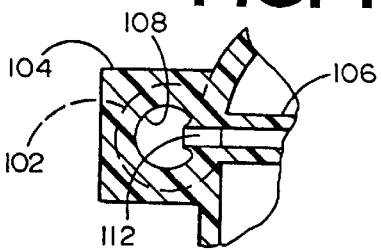

Another significant improvement is shown in FIG. 7. The suction body 60 shown in FIG. 7 is configured as an elbow 65, but is attached to a conventional suction cover 75 having a planar internal surface without any special structure to facilitate interface with the induction stem. More specifically, as shown in FIG. 7 and in FIGS. 8–12, the improved induction stem of the present invention comprises a first tubular portion 80 and a second tubular portion 82, the latter being configured to fit axially within the former in slideable engagement therewith. Portion 80 has a pair of integral internal beads 84 at one end. Portion 82 has an elongated recess 86 adapted to receive a bead 84. Recess 86 has a first race 87 which terminates short of the end of tubular portion 82 and a second race 89 which terminates at the end of tubular portion 82. A race segment 91 interconnects races 87 and 89. An identical recess 86 is provided on the opposite radial surface of tubular portion 82 whereby each such race is positioned to interface with a corresponding bead 84 of portion 80. The end of tubular portion 82 opposite the termination of race 89, comprises an annular radial flange 85. A cylindrical compression spring 88 is placed over the tubular portion 82 and engages the flange 85. When the two tubular portions 80 and 82 are interconnected, beads 84 initially ride in race 89. Upon a twist of portion 82 relative to portion 80, beads 84 ride in race segment 91 to race 87 thereby securing the portions 80 and 82 to each other while allowing reduction in their combined length by compression of spring 88. Race 89 is open after the tube portions 80 and 82 are assembled and thus provides a bleed path which is comparable to channel 49 of the FIG. 1 embodiment and the interior of tubular portion 82 is comparable to the interior of stem 27.

Tubular portion 82 is configured to receive an interior tube extension 90 and to being compressed within elbow body 65 with one end of portion 80 axially engaging the interior surface of suction cover 75. The exterior end of tube extension 90 is provided with a radial recess 92 to facilitate connection to the induction tube and a guard 94 surrounds that connection to prevent inadvertent disconnection. A break-away cap 95 is removed during installation to connect to the induction tube 12. The principal advantage of the improved version of the invention shown in FIGS. 7–12 is a result of the axially compressible induction stem. More specifically, the improved stem permits use of the conventional cover 75 and obviates special tooling that would otherwise be required to produce the special suction covers shown in FIGS. 1 and 3.

Referring to FIGS. 13 through 17, it will be seen that in an alternative embodiment, suction assembly 100 provides a rear tube 102 supported by a bracket 104. Interior tube extension 106 leads to a passage 108 withing tube 102. A breakaway cap 110 provides selective opening of a flow channel 112 which allows extension 106 to communicate with passage 108. Selective opening of the channel 112 permits assembly 100 to be used as an ordinary elbow fitting or as a safety suction elbow according to the invention. Upon opening channel 112, one end of tube 102 is preferably capped so that water may flow out of tube 102 in only one selected direction.

Those having skill in the art to which the present invention pertains, will now as a result of the applicants' teaching herein, perceive various modifications and additions which may be made to the invention. By way of example, the specific geometry and dimensions represented by the drawings herein, may be readily altered without sacrificing the numerous advantages described herein. Accordingly, all such modifications and additions are deemed to be within the scope of the invention which is to be limited only by the appended claims and their equivalents.

We claim:

1. A suction assembly connected through an aperture in a wall of a whirlpool bath or spa tub below the water in the tub and connected to an inlet of a pump used for recirculating the water and propelling the water through a plurality of whirlpool bath jets; the assembly comprising:

a face on the inside of the tub wall, the face having a plurality of apertures through which the recirculated water flows into the assembly and into the inlet;

a body on the outside of the tub wall and connected to said face through said aperture, said body having a main chamber connected to said inlet and an elongated induction chamber open to ambient through an induction tube extended toward the top of the tub;

said face further abutting a face tube extending through said tub wall aperture, exterior of said tub in overlapping coaxial relation to said induction chamber and forming a bleed path therebetween, whereby pressure in said face tube forming a column of water in said induction tube during normal operation of said suction assembly and whereby blockage of said face reduces said pressure and empties said column of water thereby permitting air to enter said pump inlet and cease said circulation;

said face tube and said induction chamber comprising a pair of coaxial overlapping concentric tubes said face tube being spring-biased to abut said face.

2. The suction assembly recited in claim 1 wherein said induction tube is connected to an air inlet of said whirlpool bath.

3. The suction assembly recited in claim 1 wherein said face comprises a smooth interior surface.

4. A spa or whirlpool bath having at least one venturi-type jet having an air inlet and having a suction assembly comprising:

a body having a main chamber and an induction chamber, an integral pump inlet pipe connected to said main chamber an induction tube connected to said induction chamber;

a face connected to said body, said face having a plurality of suction apertures providing passages for water flow into said body and into said pump inlet pipe, said face abutting a face tube extending into said body in overlapping coaxial relation to said induction chamber and forming a bleed path therebetween, wherein said face tube and said induction chamber are configured as concentric overlapping coaxial tubes compressively spring-biased for relative slidable engagement therebetween;

said induction tube being connected to said air inlet of said jet.

5. The suction assembly recited in claim 4 wherein said face comprises a smooth interior surface and wherein said face tube compressively engages said smooth interior face surface.

* * * * *